6/24/80 XR 4,209,776

United States Patent [19]

Frederick

[11] 4,209,776

[45] Jun. 24, 1980

[54] VIBRATORY AND ULTRASONIC FENCE INTRUDER DETECTION SYSTEM

[75] Inventor: Richard M. Frederick, Minneapolis, Minn.

[73] Assignee: Electronic Surveillance Fence Security, Inc., Minneapolis, Minn.

[21] Appl. No.: 927,476

[22] Filed: Jul. 24, 1978

[51] Int. Cl.[2] ..... G08B 13/02; G08B 13/16

[52] U.S. Cl. ..... 340/541; 340/522; 340/693; 340/566; 367/93; 256/1

[58] Field of Search ..... 340/541, 522, 521, 558, 340/559, 560, 566, 693; 256/1

[56] References Cited

U.S. PATENT DOCUMENTS

| | | | |
|---|---|---|---|
| 3,960,007 | 6/1976 | Swensen | 340/16 R |
| 3,967,262 | 6/1976 | Reich et al. | 340/541 |
| 4,005,397 | 1/1977 | Blair | 340/566 |
| 4,023,155 | 5/1977 | Miller | 340/560 |
| 4,097,025 | 6/1978 | Dettmann et al. | 340/541 |
| 4,103,293 | 7/1978 | La Forge, Jr. | 340/522 |

*Primary Examiner*—Glen R. Swann, III
*Attorney, Agent, or Firm*—Kinney, Lange, Braddock, Westman and Fairbairn

[57] ABSTRACT

A fence surveillance and security system includes a plurality of sections of relatively rigid electrical conduit which are supported by a fence. A plurality of housings are provided at spaced intervals between two adjacent sections of the conduit. Within each housing is mounted both a vibration sensor and an ultrasonic intrusion sensor. The vibration sensor produces a vibratory electrical signal in response to vibration transmitted to the housing by the conduit. The ultrasonic intrusion sensor transmits ultrasonic waves and senses changes in the ultrasonic waves resulting from movement of an object in a zone proximate the fence. The system, therefore, provides detection of persons climbing, lifting, or cutting the fence itself, as well as setting up a zone of protection to detect any movement within a predetermined distance of the fence.

9 Claims, 7 Drawing Figures

VIBRATORY AND ULTRASONIC FENCE INTRUDER DETECTION SYSTEM

BACKGROUND OF THE INVENTION

The present invention relates to security systems. In particular, the present invention is an improved electronic surveillance and fence security system which employs a plurality of housings each containing both a vibration sensor for sensing vibrations associated with tampering with the fence itself, and an ultrasonic intrusion sensor for detecting movement within a zone proximate the fence.

It is quite common to employ a wire fence as a barrier surrounding an area to be protected. It is imperative, however, if the area is to be adequately secured, to provide some means for providing an alarm or warning if any attempt is made to cut, climb, or otherwise interfere with the fence. Various devices have been employed in the past to provide a warning if any attempt is made to interfere with the protective function of the fence.

One particularly advantageous system is described in U.S. Pat. No. 4,097,025 by Charles R. Dettman and John J. Frederick, which is assigned to the same assignee as the present application. This system includes a plurality of sections of relatively rigid electrical conduit supported on and in contact with the fence, a plurality of housings interposed between adjacent sections of the conduit, and a vibration sensor secured in each of the housings. When the fence, and therefore the conduit is vibrated, these vibrations are transmitted to one or more of the housings. The vibration sensors produce a vibratory electrical signal in response to the vibrations. While this system has been found to be very successful in detecting climbing, lifting, and other tampering with the fence itself, it does not, by its very nature, provide indications of the presence of movement of persons near but not touching the fence.

One continuing problem in the field of security systems is the "nuisance alarm" or "false alarm" problem. Ideally, a security system should be as sensitive as possible, so that any intrusion is sure to be detected. The problem, however, is that the more sensitive the security system, the more prone it is to generate nuisance alarms. A nuisance alarm causes inconvenience to private security forces, the police, or both. If the nuisance alarms are frequent enough, the alarms may eventually be ignored, thereby defeating the entire purpose of having a security system.

In the case of the system described in the Dettman and Frederick patent, it has been found that nuisance alarms can be caused by animals or persons inadvertantly bumping against the fence when there is no real security danger. This can, in some cases, lead to nuisance alarms at very inconvenient times, such as the middle of the night. The choice between having a highly sensitive vibration sensing system of the type described in the Dettman and Frederick U.S. Pat. No. 4,097,025, and having a system with a reduced sensitivity but fewer nuisance alarm problems is a difficult and unattractive one.

SUMMARY OF THE INVENTION

The present invention is an improved security system for use in combination with a fence. The system includes a plurality of sections of relatively rigid electrical conduits supported on and in contact with the fence. A plurality of housings are interposed and connected with adjacent sections of the conduit so that vibrations of the fence will cause vibrations of the conduit which in turn will be transmitted to the housing. Each housing contains both a vibration sensor and an ultrasonic intrusion sensor.

The vibration sensor is secured in each of the housings and is responsive to the vibrations transmitted to the housing. Each vibration sensor produces a vibratory electric signal in response to the vibrations transmitted to the housing from the conduit.

The ultrasonic intrusion sensor is also mounted in each of the housings in a manner which effectively acoustically decouples the ultrasonic sensor from the housing. The ultrasonic intrusion sensor transmits ultrasonic waves and senses changes in the ultrasonic waves resulting from movement of an object in a zone of protection proximate the fence which is associated with the ultrasonic intrusion sensor. The operating parameters of the ultrasonic sensor and the spacing between housings provides a zone of protection associated with each ultrasonic sensor which partially overlaps an adjacent zone of protection produced by the ultrasonic sensor at the next housing. As a result, a substantially continuous zone of protection proximate the fence is produced.

The present invention, therefore, not only detects disturbances in the fence caused by climbing, lifting, or cutting of the fence itself, but also detects movement within a zone proximate the fence.

The system of the present invention preferably includes means for selecting whether an alarm will be produced in response to: (1) the vibratory electrical signals from the vibration sensors only, (2) the ultrasonic sensor signals only, (3) either the vibratory electrical signals or the ultrasonic sensor output signals, or (4) only if both the vibratory electrical signals and the ultrasonic sensor output signals are present. In this fourth mode, in which both the vibration sensor and the ultrasonic sensor must indicate the presence of an intruder, the nuisance alarm problem is significantly reduced, since it is unlikely that both sensors would produce a nuisance or false alarm at the same time. As a result, both sensors can be made extremely sensitive without concern for the nuisance alarm problem.

DETAILED DESCRIPTION OF THE PREFERRED EMBODIMENTS

Figure 1:
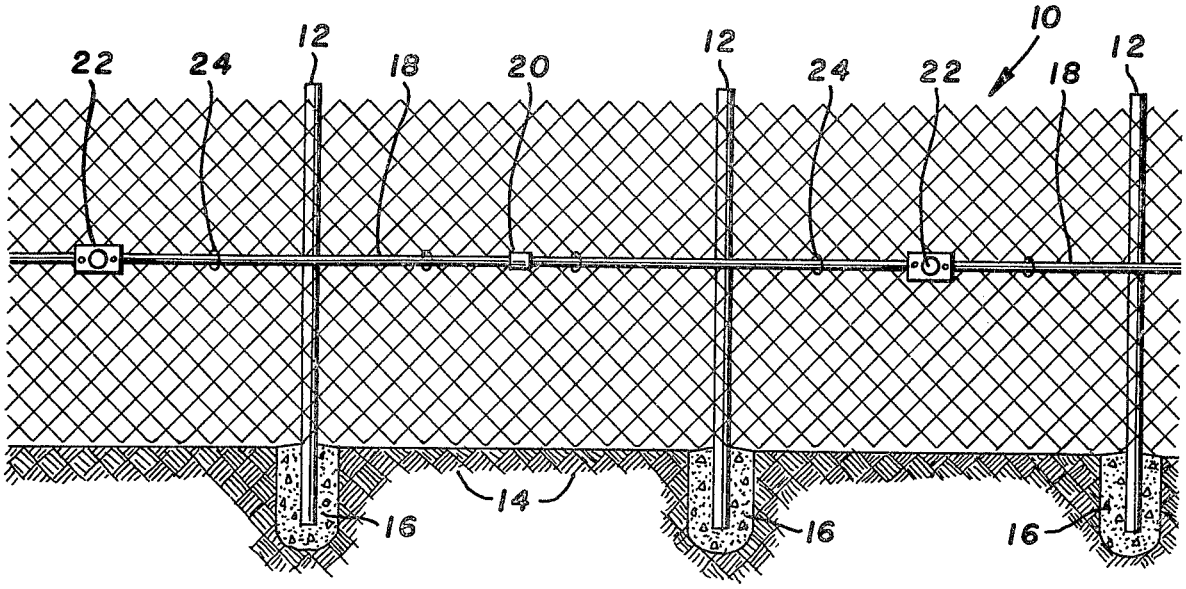
FIG. 1 is an elevational view, partly schematic, showing a section of fence including the surveillance and security system of the present invention attached thereto.

FIG. 1 shows a fence 10 which is to be protected by the present invention. This fence 10 is typically of a chain link type and is firmly supported on spaced posts 12 which are fastened into ground 14 by concrete 16.

The system of the present invention includes a plurality of sections of relatively rigid conduit 18. These sections of conduit 18 are coupled together by suitable coupling devices 20 and by junction boxes 22. Conduit 18 and junction boxes 22 are supported from fence 10 independently of posts 12 by suitable fastening means 24.

Each junction box 22 includes both a vibration sensor, which senses vibrations indicative of intruders climbing, lifting, or cutting the fence, and an ultrasonic intrusion sensor which provides a zone of protection near the fence and inside the area enclosed by the fence. The vibration sensor and ultrasonic intrusion sensor in each of the junction boxes 22 together provide complete surveillance and protection of the fence and the areas in close proximity of the fence.

In the preferred embodiments of the present invention, the ultrasonic intrusion sensor provides the zone of protection inside the area protected by the fence. As a result, the ultrasonic intrusion sensor provides an indication of the presence of a person within the fence, even if that person has somehow made it over the fence without disturbing the vibration sensor. The zone of protection is provided inside, rather than outside the fence because it eliminates the possibility of false alarms by persons passing near the fence. As a result, the system may be used even if there is a public road or sidewalk immediately adjacent the fence, since a passing car or pedestrian will not affect the ultrasonic intrusion sensor which has a zone of protection inside rather than outside the fence.

In the preferred embodiments of the present invention, the vibration sensor which is mounted within junction box 22 and the conduit 24 are of the type described by Dettman and Frederick. The conduit 18 forms a vital portion of the system by transmitting vibrations imparted to conduit 18 by vibration or movement of the fence or of the conduit itself. These vibrations are transmitted by conduit 18 to the adjacent junction box or boxes 22. The vibration sensor senses these vibrations and generates vibratory electrical signals which are subsequently processed and are used to control an alarm device.

In addition to its vibration transmitting function, conduit 18 also houses electrical conductors necessary to connect the vibration sensors in each of the junction boxes 22 to associated vibration signal processors and ultrasonic intrusion sensor signal processors, and also connects ultrasonic signal processing circuitry in each junction box 22 to a main control panel and alarm. The electrical conductors may be, for example, in the form of a multiwire telephone-type cable running through the conduits 18.

Figure 2:
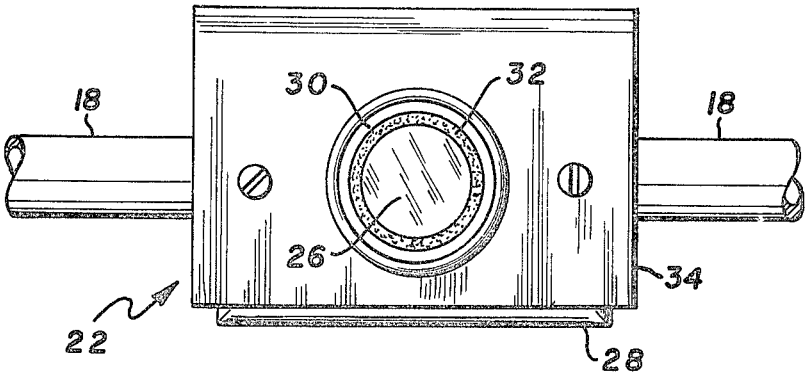
FIG. 2 is a front view of a junction box containing both an ultrasonic intrusion sensor and a vibration sensor in accordance with the present invention.
Figure 4:
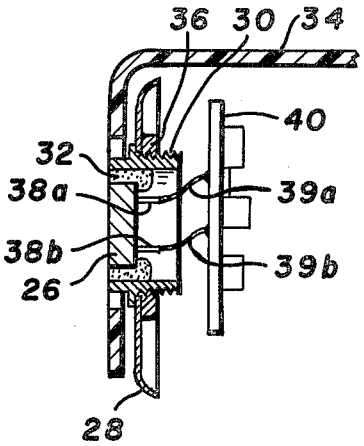
FIGS. 3 and 4 are rear and cross-sectional views, respectively, of the front cover and rain shield of the junction box of FIG. 2.
Figure 3:
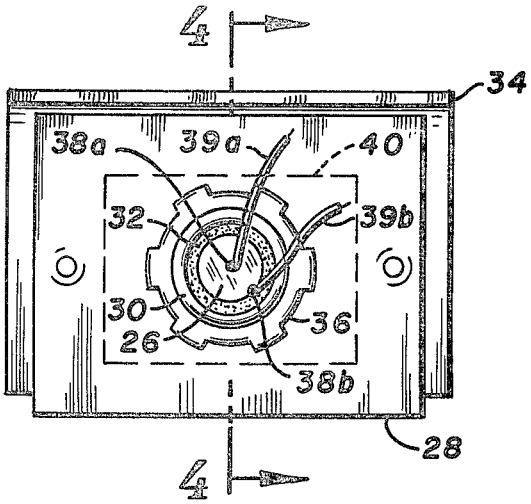
Figure 5:
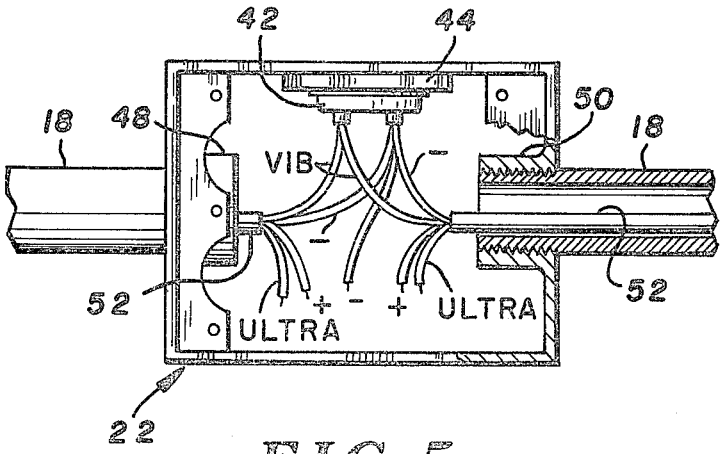
FIG. 5 is a front view of the junction box of FIG. 2 with the front cover and rain shield removed.

FIGS. 2 through 5 show a preferred embodiment of junction box 22 of the present invention. FIG. 2 is a front view of junction box 22 with the front cover and rain shield in place. FIGS. 3 and 4 are rear and cross-sectional views, respectively, of the front cover and rain shield. FIG. 5 shows junction box 22 with the rain shield and front cover removed.

As shown in FIGS. 2–5, the ultrasonic intrusion sensor used in a preferred embodiment of the present invention includes a single piezoelectric transducer 26, which is mounted on front panel 28 with a threaded mounting 30. An acoustic decoupling material 32, which for example may be foam rubber, acoustically decouples transducer 26 from threaded mounting 30, and therefore, the remainder of junction box 22. Acoustic decoupling material 32 prevents vibrations generated by transducer 26 from being transmitted to the junction box 22 and thereby creating false vibration signals which could be detected by vibration sensor 42 also mounted in junction box 22. Similarly, acoustic decoupling material 32 prevents vibrations to fence 10 and transmitted to junction box 22 by conduit 18 from being transmitted to transducer 26, thereby erroneously affecting the operation of transducer 26. In other words, acoustic decoupling material ensures that neither the ultrasonic intrusion sensor nor the vibration sensor operates to produce false signals in the other sensor.

Although the present invention may also use sensors having separate transmitting and receiving transducers, the use of a single ultrasonic transducer 26 is much more desirable since both the vibration sensing transducer and the ultrasonic transducer, along with the signal processing circuitry for the latter must be located within and on the relatively small junction box 22. By using a single ultrasonic transducer for both transmitting and receiving, it becomes possible to use a standard junction box for this purpose.

As best shown in FIG. 4, mounting 30 and transducer 26 protrude beyond the front surface of plate 28 and into a hole in rain shield 34, which hole is slightly larger than transducer 26 and mounting 30. Rain shield 34 is spaced from the front surface of the front cover 28 so that the front surface of rain shield 34 is essentially co-planar with the front surface of transducer 26.

As shown best in FIG. 4, threaded mounting 30 is held securely in place by nut 36. This also permits easy removal and replacement of the transducer assembly as necessary.

On the backside of transducer 26, there are two terminal posts **38*a* and 38*b*. Electrical lead wires 39*a* and 39*b* connect terminals 38*a* and 38*b* to ultrasonic signal processing circuitry carried on circuit board 40. Circuit board 40 is spaced from and attached to the back surface of front cover 28**.

The ultrasonic signal processing circuitry on circuit board 40 provides electrical driving signals to transducer 26, derives electrical signals from transducer 26 which are indicative of disturbances in the ultrasonic wave pattern generated by transducer 26, and supplies output signals which indicate the presence of an intruder in the zone of protection associated with that particular transducer.

As shown in the Figures, each junction box 22 has an ultrasonic transducer 26 and accompanying ultrasonic signal processing circuitry. The use of separate ultrasonic signal processing circuitry at each junction box greatly simplifies the transmission of signals of the various ultrasonic intrusion sensors to a main control panel. The ultrasonic signal processing circuitry may take any one of many well known forms, but preferably is capable of being provided on a single circuit board which is mounted in each of the junction boxes 22. U.S. Pat. No. 3,960,007 by E. T. Swensen shows examples of one type of a suitable ultrasonic sensor and signal processing circuitry. *Guidebook of Electronic Circuits,* Markus ed., Chap. 127 (1974), illustrates other examples of ultrasonic intrusion sensor circuits.

By properly selecting the operating parameters of ultrasonic transducer 26 and the spacing of junction boxes 22, the zone of protection associated with each ultrasonic transducer 26 partially overlaps an adjacent zone of protection of the ultrasonic intrusion sensor at the next junction box. In one preferred embodiment, the zone of protection is approximately 18 feet in radius, and the spacing between junction boxes 22 is approximately 30 feet. As a result, a substantially continuous zone of protection is produced along the entire length of the fence 10.

FIG. 5 shows junction box 22 with the front plate 28 and rain shield 34 removed. The vibration sensing apparatus mounted in junction box 22 is generally similar to that shown in previously mentioned U.S. Pat. No. 4,097,025 and will not be described in detail. The viration sensor 42, which preferably is a piezoelectric crystal, is mounted to an insulating material 44, which is in turn mounted to the top surface 46 of junction box 22. Vibrations are transmitted to junction box 22 by conduit 18 which is threaded into inwardly extending nipples 48 and 50 of junction box 22. The vibrations are transmitted from junction box 22 through insulating material 44 to vibration sensor 42, which produces vibratory electrical signals in response to the vibrations.

In addition to their vibration transmitting function, conduit sections 18 also carry multiwire electrical cable 52. Cable 52 transmits the vibratory electrical signals produced by vibration sensor 42 to the vibration sensor signal processing circuitry. In addition, cable 52 provides connection of the ultrasonic signal processing circuitry with the main control panel.

Figure 6:
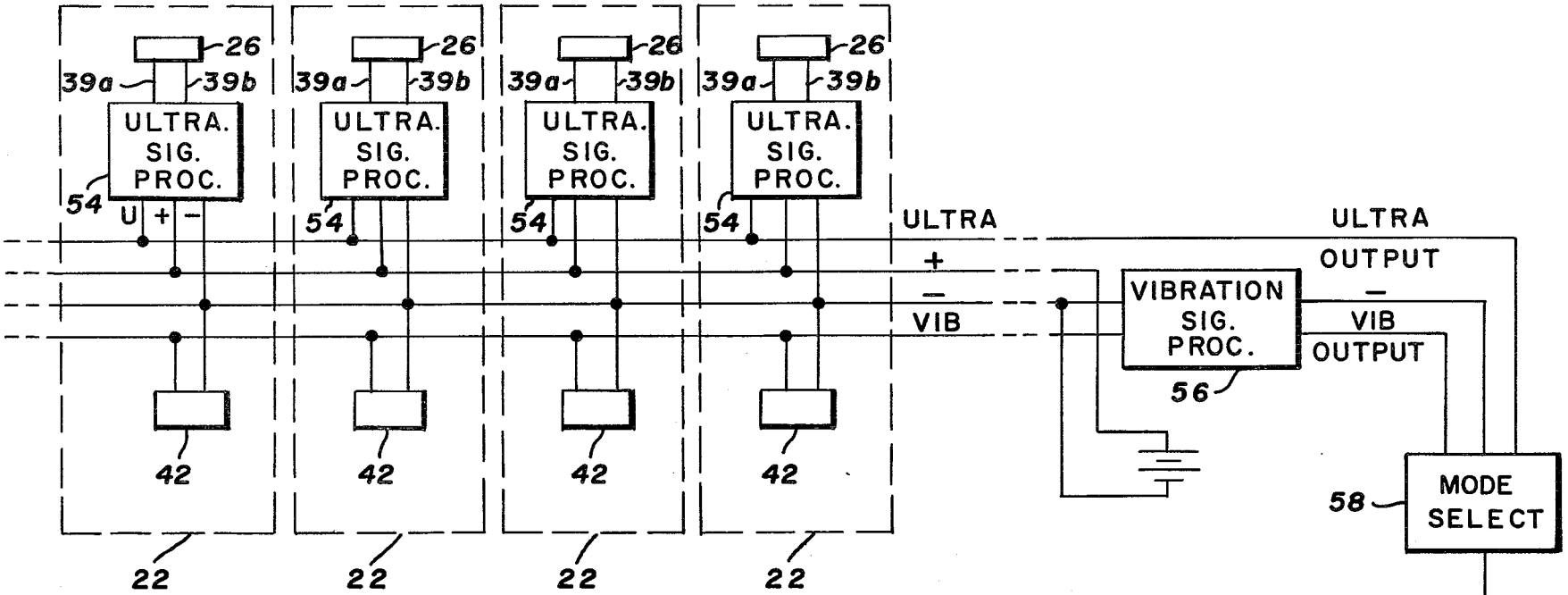
FIG. 6 is an electrical block diagram of the system of the present invention.

FIG. 6 shows an electrical block diagram of one embodiment of the present invention. In this embodiment, a plurality of junction boxes 22 each include a vibration sensor 42, an ultrasonic transducer 26, and associated ultrasonic signal processing circuitry 54. The signals from vibration sensors 42 are supplied through conduit 18 and cable 52 on the "Vib" and "−" wires to vibration sensor signal processor 56. In the preferred embodiment, vibration sensor signal processor 56 may be similar to the embodiment shown in the previously mentioned U.S. Pat. No. 4,097,025.

The ultrasonic transducers are connected to ultrasonic signal processing circuitry 54, which receives power from the "+" and "−" wires and supplies an output on the "Ultra" and "−" wires. From ultrasonic signal processing circuitry 54, the transducers 26 are supplied electrical drive signals which drive the transducers to produce ultrasonic waves. Ultrasonic signal processing circuitry 54 also receives signals or monitors the change or impedance of transducer 26 to determine any disturbance or disruption of the ultrasonic wave pattern produced by the transducer. Any intruder within the zone of protection associated with a transducer 26 will disrupt the wave pattern generated by that transducer and will cause ultrasonic signal processing circuitry 54 to produce an output signal on the "Ultra" and "−" lines which indicates that an intruder is near the fence.

In the case of both vibration sensors 42 and ultrasonic transducers 26, they are preferably grouped so that a determination may be made of the general location of the disturbance as well as the mere existence of the disturbance. In this case, an additional "Ultra" wire and an additional "Vib" wire are required for each additional group of sensors. For simplicity, only four junction boxes 22 in a single group are illustrated in FIG. 6. The number of junction boxes 22 and the number of groups will depend, of course, on the length of fence protected and the particular requirements of the user.

The output signals of vibration sensor signal processor 56 and ultrasonic signal processing circuitry 54 are supplied to mode select circuitry 58. In one preferred embodiment mode select circuitry 58 determines whether alarm 60 will be actuated by (1) the fence vibration only (i.e. only the signals from vibration sensor signal processor 56); (2) ultrasonic disturbance only (i.e. the output signal from ultrasonic signal processing circuitry 54 only); (3) either fence vibration or ultrasonic disturbance; or (4) both ultrasonic disturbance and fence vibration (both being needed to cause alarm).

Figure 7:
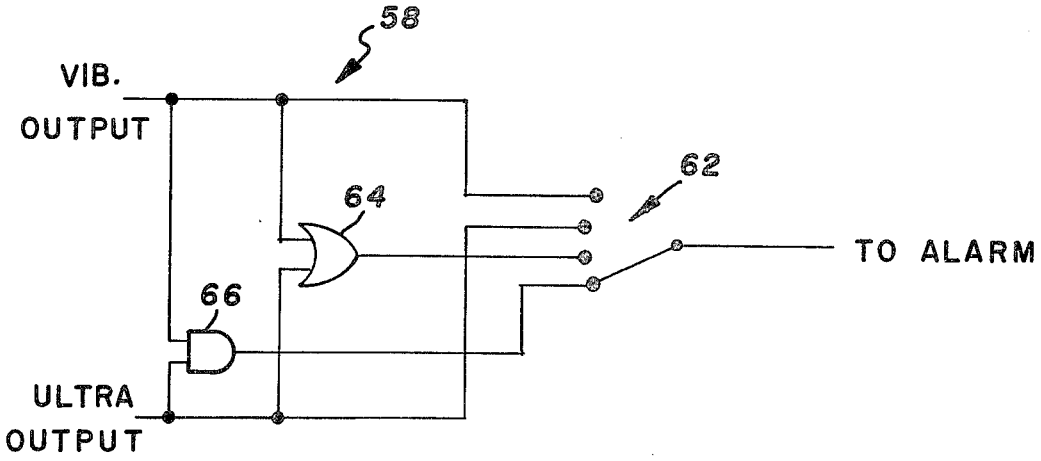
FIG. 7 is an electrical schematic diagram of mode selection circuitry for use in one embodiment of the present invention.

FIG. 7 shows one possible configuration of mode select circuitry 58. In this embodiment, the output signals from vibration sensor signal processor 56 and ultrasonic signal processing circuitry 54 are supplied to a mode select switch 62, and to OR gate 64 and AND gate 66. Depending upon the position of mode select switch 62: (1) only the vibration output signal is supplied to alarm 60; (2) only the ultrasonic output signal is supplied to alarm 60; (3) the output of OR gate 64 is supplied to alarm 60; or (4) the output of AND gate 66 is supplied to alarm 60. Since in some cases the vibration signal may precede the ultrasonic signal, appropriate time delay circuitry may be provided if necessary so that the two signals occur at the same time in the event of an alarm condition.

The final mode in which both ultrasonic disturbance and fence vibration are needed to cause an alarm is particularly advantageous because it eliminates many of the nuisance alarm problems of prior art security systems. Both the vibration sensor and the ultrasonic intrusion sensor may be more sensitive than they could be if used alone, since there is a much lower likelihood that they both would produce a nuisance alarm at the same time. As a result, the system of the present invention provides not only higher sensitivity, but also a reduced likelihood of nuisance alarms.

In one preferred embodiment, both ultrasonic disturbance and fence vibration may be required to cause an alarm, but either one individually will indicate a sub-alarm. If the sub-alarm persists, the security force can investigate to determine the cause of the sub-alarm. In this way, a system failure or a persistent cause of nuisance alarms may be determined and corrected without the occurrence of a major alarm which proves to be false.

It can be seen that the present invention, which uses both a vibration sensor and an ultrasonic intrusion sensor mounted in the same junction box supported on a fence, provides important advantages over prior art systems. The system of the present invention not only detects climbing, lifting, or cutting of the fence itself, it sets up a zone of protection near the fence so that intruders who are near the fence but have not touched the fence are also detected. The system follows land contour, is effective around corners of the fence, is fully supervised, is effective in rain, snow, or fog, and operates in a zone proximate the fence as well as the fence fabric itself.

In conclusion, although the present invention has been described with reference to preferred embodiments, workers skilled in the art will recognize that changes may be made in form and detail without departing from the spirit and scope of the invention.

What is claimed is:

1. In combination with a fence enclosing an area to be protected against intrusion and supported by a plurality of spaced rigid, substantially vertical fence posts, an intrusion detection system comprising:

a plurality of sections of relatively rigid electrical conduit supported on and in contact with the fence serially therealong and independently of the fence posts so that relatively small vibrations of the fence cause vibration of the conduit in contact therewith;

a plurality of housings, each interposed between and having a connection with two adjacent sections of the conduit so that the sections are serially connected together by the housings;

a vibration sensor secured in each of the housings and responsive to vibrations transmitted to the housing in which it is located, each of the vibration sensors being effective to produce a vibratory electrical signal in response to the conduit being vibrated;

an ultrasonic intrusion sensor mounted in each of the housings for sensing changes in ultrasonic waves resulting from movement of an object in a zone proximate the fence, each of the ultrasonic intrusion sensors being effective to produce an output signal in response to said changes;

an indicating device;

first connecting means operatively connecting a group of the vibration sensors to the indicating device; and second connecting means operatively connecting a group of the ultrasonic intrusion sensors to the indicating device;

whereby the indicating device in response to said vibratory signals and/or said output signals, indicates an intrusion.

2. The combination of claim 1 wherein each ultrasonic intrusion sensor comprises:

ultrasonic transducer means for transmitting and receiving ultrasonic waves; and signal processing circuitry mounted in the housing for deriving, from the ultrasonic transducer means, said output signals, and supplying such output signals to the second connecting means.

3. The combination of claim 2 and further comprising:

decoupling means for acoustically decoupling the ultrasonic transducer means from the housing.

4. The combination of claim 2 and further comprising:

select means for selecting whether the indicating device will respond to the vibratory electrical signals from the vibration sensors only, the ultrasonic sensor output signals only, either the vibratory electrical signals or the ultrasonic sensor output signals, or only both the vibratory electrical signals and the ultrasonic sensor output signals.

5. The combination of claim 2 wherein the ultrasonic transducer means is mounted proximate a front surface of the housing and wherein the zone proximate the fence extends outward from the front surface.

6. The combination of claim 5 wherein the ultrasonic transducer means is a piezoelectric element used for both transmitting and receiving ultrasonic waves.

7. The combination of claim 5 wherein the zones associated with ultrasonic intrusion sensors in adjacent housings are partially overlapping.

8. The combination of claim 1 wherein the zone proximate the fence is within the area enclosed by the fence.

9. The combination of claim 8 wherein the indicating device provides an alarm only if both a vibration sensor and an ultrasonic intrusion sensor indicate presence of an intruder.

* * * * *